US005356200A

United States Patent [19]

Stumpf et al.

[11] Patent Number: 5,356,200

[45] Date of Patent: Oct. 18, 1994

[54] UNITARY BRAKE FOR A CHAIR TILT MECHANISM

[75] Inventors: William S. Stumpf, Kitchener; Art A. Patton, Waterloo, both of Canada

[73] Assignee: Doerner Products Ltd., Waterloo, Canada

[21] Appl. No.: 965,206

[22] Filed: Oct. 23, 1992

[51] Int. Cl.[5] ..... A47C 1/027

[52] U.S. Cl. ..... 297/328; 297/374; 297/306; 297/337

[58] Field of Search ..... 297/328, 300, 301, 313, 297/316, 320, 328, 337, 364, 374, 375, 376, 306

[56] References Cited

U.S. PATENT DOCUMENTS

| | | | |
|---|---|---|---|
| 2,278,080 | 3/1942 | Koenigkramer et al. | 297/328 |
| 3,093,413 | 6/1963 | Chancellor, Jr. . | |
| 3,740,791 | 6/1973 | Bulin | 297/376 |
| 4,198,094 | 4/1980 | Bjerknes et al. | 297/328 |
| 4,314,728 | 2/1982 | Faiks | 297/353 |
| 4,392,686 | 7/1983 | Beer | 297/376 |
| 4,596,421 | 6/1986 | Schmitz | 297/301 |
| 4,629,249 | 12/1986 | Yamaguchi | 297/301 |
| 4,636,004 | 1/1987 | Neumüller | 297/374 |
| 4,693,514 | 9/1987 | Volkle | 297/374 |
| 4,718,725 | 1/1988 | Suhr et al. | 297/326 |
| 4,889,385 | 12/1989 | Chadwick et al. | 297/304 |
| 4,936,630 | 6/1990 | Hobb | 297/363 |
| 4,966,412 | 10/1990 | Dauphin | 297/320 |
| 5,066,069 | 11/1991 | DeGelder | 297/374 |

FOREIGN PATENT DOCUMENTS

| | | |
|---|---|---|
| 0394784 | 10/1990 | European Pat. Off. . |
| 0549538 | 6/1993 | European Pat. Off. . |
| 3424756 | 2/1985 | Fed. Rep. of Germany . |
| 737228 | 12/1932 | France . |
| 2101996 | 3/1972 | France . |
| 2491310 | 4/1982 | France . |
| 1256388 | 12/1971 | United Kingdom . |
| 1400509 | 7/1975 | United Kingdom . |
| 1430576 | 3/1976 | United Kingdom . |

*Primary Examiner*—Clifford D. Crowder
*Assistant Examiner*—Amy B. Vanatta
*Attorney, Agent, or Firm*—Samuels, Gauthier & Stevens

[57] ABSTRACT

There is disclosed a unitary brake for a chair tilt mechanism. The chair tilt mechanism is of the type having a seat back support mechanism biased with respect to a seat tilt mechanism, the seat back support mechanism provided with a mounting bracket and the seat tilt mechanism has a housing attachable to the underside of a chair. The mounting bracket is pivotally attached to the housing adjacent to an end portion thereof. The unitary brake comprises a spindle bracket pivotally mounted in the housing for receiving therein a chair support spindle. The spindle bracket has a plurality of parallel slotted arms extending therefrom with the spindle bracket and the arms being of one piece unitary construction. The unitary brake includes a rear lammal pivotally mounted on the mounting bracket. The rear lammal includes arms interleaved with the spindle bracket arms. The rear lammal arms have slots extending therethrough which are in registration with the slots in the spindle bracket arms. The registered slots are for receiving a locking bolt transversely through the interleaved arms. The locking bolt is movable between a first position in which the interleaved arms are compressed together for locking the seat and seat back in position and a second position in which the arms of the spindle bracket are free to move with respect to the arms of the rear lammal means so that the seat can pivot about the horizontal and the seat back can pivot to and fro about the vertical.

25 Claims, 9 Drawing Sheets

UNITARY BRAKE FOR A CHAIR TILT MECHANISM

FIELD OF THE INVENTION

The present invention relates to a chair tilt mechanism for chair seats.

BACKGROUND OF THE INVENTION

Comfortable and user friendly office equipment which can be readily adapted to a user's individual needs is a prerequisite for creating an office work environment conducive to maximum productivity. Office chairs are an integral part of any office environment and chairs having features which can be adjusted to meet a user's posture requirements clearly play a pivotal role in contributing to a user's comfort level. In particular, chairs having seat tilt mechanisms are well known and employ the user's weight to move the chair seat against a spring bias.

These tilt mechanisms include a brake to lock the seat in place. The brake includes a bracket mounted in the tilt mechanism housing into which the seat spindle is inserted. At one end of the bracket there is attached a plurality of longitudinal, flat steel arms each having a hole through the end spaced from the bracket. A plurality of separate, longitudinal and flat steel arms having holes in each end thereof are mounted in the tilt mechanism bracket so that one end of the separate steel flats are interleaved between the ends of the arms attached to the bracket. The holes in the ends of the separate arms are in registration with the holes in the arms attached to the bracket. The separate arms are mounted in the housing by a pivot rod extending between the housing side walls and transversely through the holes in the other ends of the arms. Both sets of steel arms have a surface coating applied thereto for protection. The brake includes a locking arm pivotally connected to a bolt which extends through the registered holes in the two sets of steel arms. The locking arm is connected to the bolt in such a way that pivoting the locking arm with respect to the bolt causes the bolt to move which acts to compress the two sets of arms together adjacent the holes in the arms. When the arms are compressed together, the spindle bracket, and hence the chair seat, is locked in position against pivotal movement.

Drawbacks to these devices are that the plurality of bracket arms are separately welded to the frame in parallel. This is a time consuming procedure to individually align and weld the arms to the frame. The resulting bracket and arm combination is fairly heavy in addition to being expensive to fabricate since separate, multiple welding steps are required. Further, the brake mechanism employs compression to squeeze the two sets of arms together so that during tilting movement of the seat the resulting friction between these two components causes the coating layer of each arm to be worn off thereby producing an unsightly fine powder.

Accordingly, it would be advantageous to provide an improved brake mechanism for a chair seat tilt mechanism which is lighter than the prior art devices, more economical to manufacture and which is less prone to producing an unsightly residue when in use.

SUMMARY OF THE INVENTION

The subject invention provides a chair tilt mechanism having a braking device for locking a chair seat and a seat back against movement. In one aspect the invention is directed toward a chair of the type provided with a seat tilt mechanism attached to a chair seat's underside. The seat tilt mechanism is provided with a housing and the chair has a seat back with a seat back support arm attached thereto and includes a seat back support mechanism comprising a mounting bracket pivotally attached to an end portion of said housing. The seat back support arm is attached to the mounting bracket and the chair includes spring means for biasing the mounting bracket with respect to the housing. The chair includes means defining a brake for locking the seat back support mechanism and the chair seat in position. The brake means including a spindle bracket pivotally mounted in the housing for receiving therein a chair support spindle with the spindle bracket being provided with a plurality of parallel arms extending therefrom. The arms each are provided with slots extending therethrough and the brake means includes means defining a rear lammal. The rear lammal means is pivotally mounted on the mounting bracket. The rear lammal means comprises arms interleaved with the spindle bracket arms. The rear lammal arms have slots extending therethrough which are in registration with the slots in the spindle bracket arms. The registered slots are for receiving a locking bolt transversely through the arms. The locking bolt is movable between a first position in which the interleaved arms are compressed together for locking the chair seat and the seat back in position and a second position in which the arms of the spindle bracket are free to move with respect to the arms of the rear lammal means. The spindle bracket and the arms extending therefrom are of one piece unitary construction.

In another aspect of the invention there is provided a unitary brake for a chair tilt mechanism. The chair tilt mechanism having a seat back support mechanism biased with respect to a chair seat tilt mechanism, the seat back support mechanism provided with a mounting bracket and the chair seat tilt mechanism having a housing and being attachable to a chair seat's underside, the mounting bracket being pivotally attached to the housing adjacent to an end portion thereof. The unitary brake comprises a spindle bracket pivotally mounted in the housing for receiving therein a chair support spindle. The spindle bracket is provided with a plurality of parallel arms extending therefrom and the spindle bracket and the arms extending therefrom are of one piece unitary construction. The arms each have slots extending therethrough. The unitary brake includes means defining a rear lammal which is pivotally mounted on the mounting bracket. The rear lammal means comprises arms interleaved with the spindle bracket arms. The rear lammal arms have slots extending therethrough which are in registration with the slots in the spindle bracket arms. The registered slots are for receiving a locking bolt transversely through the interleaved arms. The locking bolt is movable between a first position in which the interleaved arms are compressed together for locking the chair seat and the seat back in position and a second position in which the arms of the spindle bracket are free to move with respect to the arms of the rear lammal means so that the seat can pivot about the horizontal and the seat back can pivot to and fro about the vertical.

In yet another aspect of the invention there is provided a chair having a tiltable seat and seat back. The chair comprises a chair base having a vertically disposed spindle extending upwardly therefrom, and a seat pivotally attached to the spindle. Included is a seat back having a seat back support arm connected at one end to the seat back. A seat tilt mechanism is provided and comprises a housing attachable to an underside of the seat, and a seat back support mechanism comprising a mounting bracket pivotally attached to the housing adjacent to an end portion of the housing. The seat back support arm is attached to the mounting bracket and the mounting bracket is biased with respect to the housing. The chair includes a unitary brake comprising a spindle bracket pivotally mounted in the housing for receiving therein the chair support spindle. The spindle bracket is provided with a plurality of parallel arms extending therefrom wherein the spindle bracket and the arms extending therefrom are of one piece unitary construction. The arms each have slots extending therethrough and the unitary brake includes means defining a rear lammal. The rear lammal means is pivotally mounted on the mounting bracket and the rear lammal means comprises arms interleaved with the spindle bracket arms. The rear lammal arms have slots extending therethrough and which are in registration with the slots in the spindle bracket arms. The registered slots are for receiving a locking bolt transversely through the interleaved arms. The locking bolt is movable between a first position in which the interleaved arms are compressed together for locking the chair seat and the seat back against movement and a second position in which the arms of the spindle bracket are free to move with respect to the arms of the rear lammal means so that the seat can pivot about the horizontal and the seat back can pivot to and fro about the vertical.

BRIEF DESCRIPTION OF THE DRAWINGS

The following is a description, by way of example only, of an improved brake forming part of a chair tilt mechanism constructed in accordance with the subject invention, reference being had to the accompanying drawings, in which.

DETAILED DESCRIPTION OF THE INVENTION

Figure 1:
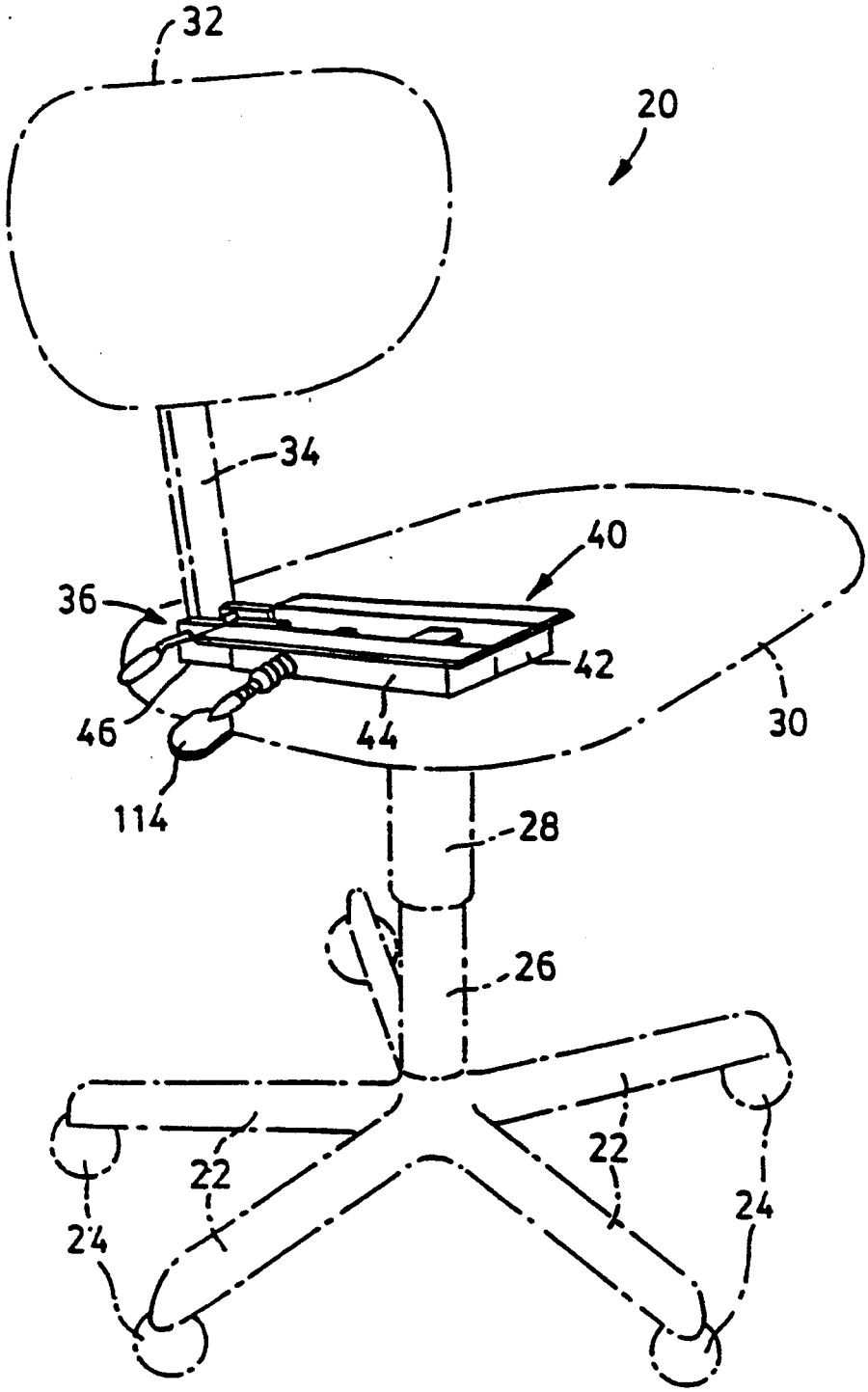
FIG.1 (PRIOR ART)
FIG. 1 is a perspective view of a chair provided with a prior art chair seat tilt mechanism.
Figure 2:
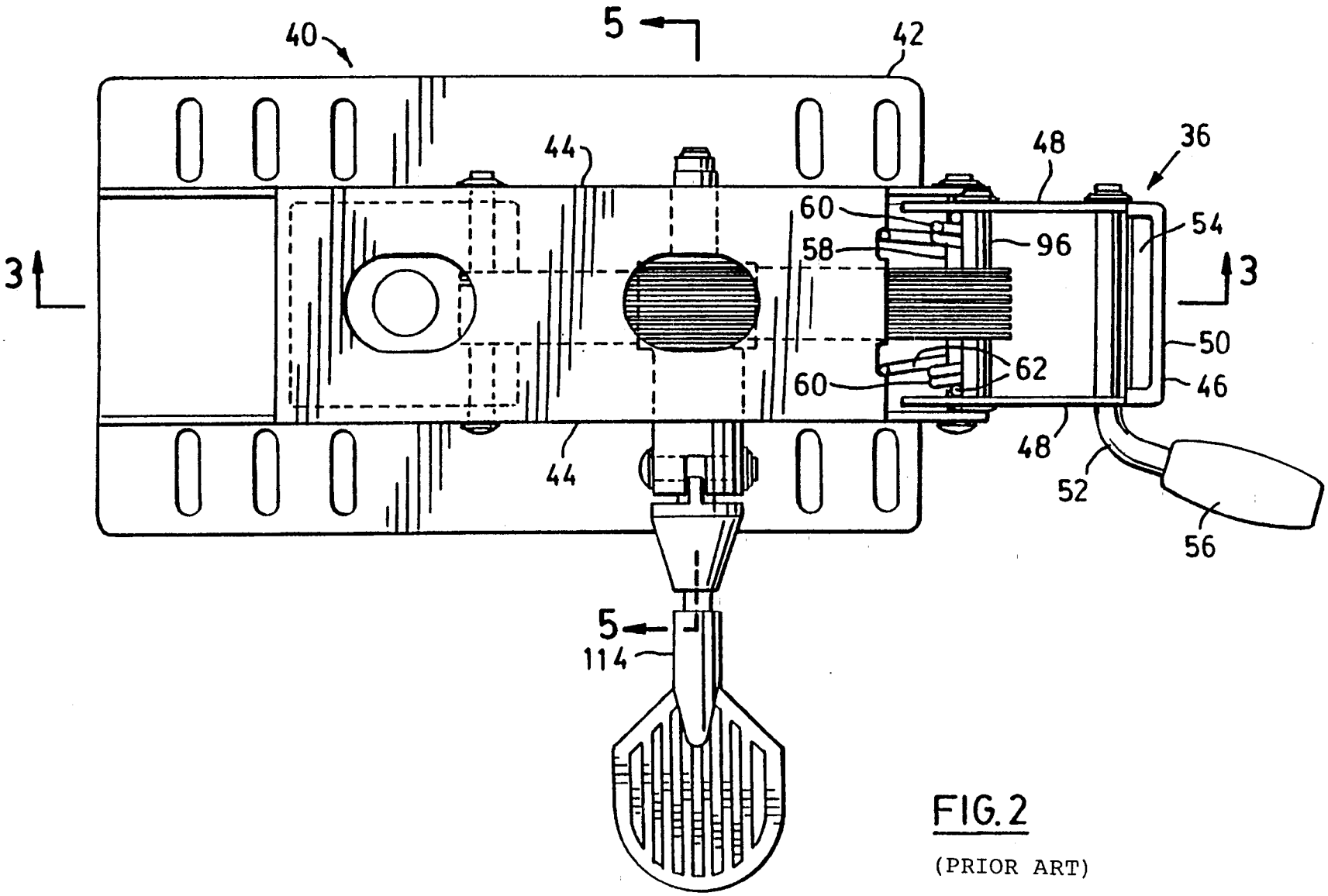
FIG. 2 (PRIOR ART)
FIG. 2 is a bottom view of a prior art chair seat tilt mechanism in the direction of arrow 2 of FIG. 1.

In the ensuing description of the structure and operation of the prior art and the new brake mechanism forming part of a seat tilt mechanism, reference will be had to the Figures wherein like numerals refer to like parts. Referring first to FIG. 1, there is shown a chair 20 of the type generally found in an office environment. Chair 20 includes supporting legs 22 each having a castor 24 attached at a lower end thereof. Legs 22 extend radially from a spindle support 26 which supports a spindle 28 which in turn is attached to a chair seat 30. A seat cushion, not shown, is attachable to the top surface of seat 30. Chair 20 is provided with a seat back 32 attached to one end of a seat back support arm 34. The other end of support arm 34 is attached to a seat back support mechanism indicated generally by numeral 36.

Referring specifically to FIGS. 1 to 5, a prior art chair tilt mechanism previously used with chair 20 will now be described. A seat tilt mechanism indicated by numeral 40 is secured to the bottom surface of seat 30. Seat tilt mechanism 40 comprises a housing 42 having side walls 44. Seat back support mechanism 36 includes a bracket 46 having side walls 48, an end wall 50 and a cam 52 mounted between side walls 48 and spaced from end wall 50 of the bracket thereby defining a passageway 54. Cam 52 includes a cam handle 56 located on the outside of bracket 46. One end of seat back support arm 34 (FIG. 1) is received in passageway 54 and rotation of handle 56 in one direction compresses and locks arm 34 in place thereby fixing seat back 32 at the desired height. Rotation of handle 56 in the other direction unlocks support arm 36 so that it can slide in passageway 54. Seat back support mechanism 36 is pivotally attached to seat tilt mechanism 40 by a rod 58 extending between side walls 44 of housing 42 and side walls 48 of bracket 46. A pair of spaced springs 60 are mounted on rod 58 and are each provided with arms 62 and 64 with arm 62 urging against housing 42 and arm 64 urging against bracket 46, best seen in FIG. 3. The action of a user sitting in the chair leaning back against seat back 32 causes bracket 46 to pivot about rod 58 against springs 60 so that when the user leans forward the springs return seat back 32 to the upright position.

Seat tilt mechanism 40 includes a brake mechanism 70 to lock seat 30 and seat back support mechanism 36 in place. Brake mechanism 70 includes a spindle bracket 72 mounted in housing 42 into which seat spindle 28 is receivable. Spindle bracket 72 comprises a rectangular frame 74 and a plurality of longitudinal, flat steel arms or front lammals 76 welded to frame 74. Each arm 76 is provided with a slot 78 through the end thereof spaced from frame 74. Both frame 74 and arms 76 are fabricated of heavy gauge steel. Spindle bracket 72 is mounted in housing 42 by a pivot rod 80 extending between side walls 44 of the housing through frame 74.

Brake mechanism 70 includes a plurality of separate, longitudinal and flat steel rear lammals or arms 90 having holes 92 in one end thereof and slots 94 in the other end. Arms 90 are mounted on a rod 96 extending between side walls 48 of bracket 46 and transversely through arms 90 in holes 92. The other end of arms 90 are interleaved between the ends of arms 76 of spindle bracket 70 and a locking bolt 98 extends transversely through arms 76 and 90 through slots 78 and 94. Both sets of steel arms have a surface coating applied thereto for protection.

Figure 3:
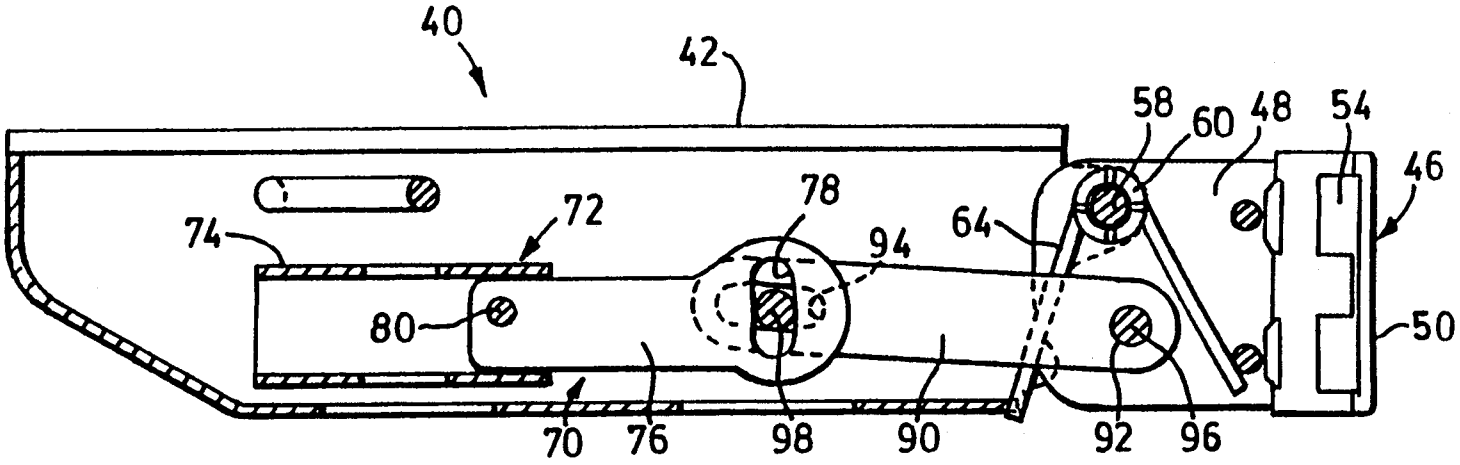
FIG. 3 is a sectional view along line 3—3 of FIG. 2.
Figure 4:
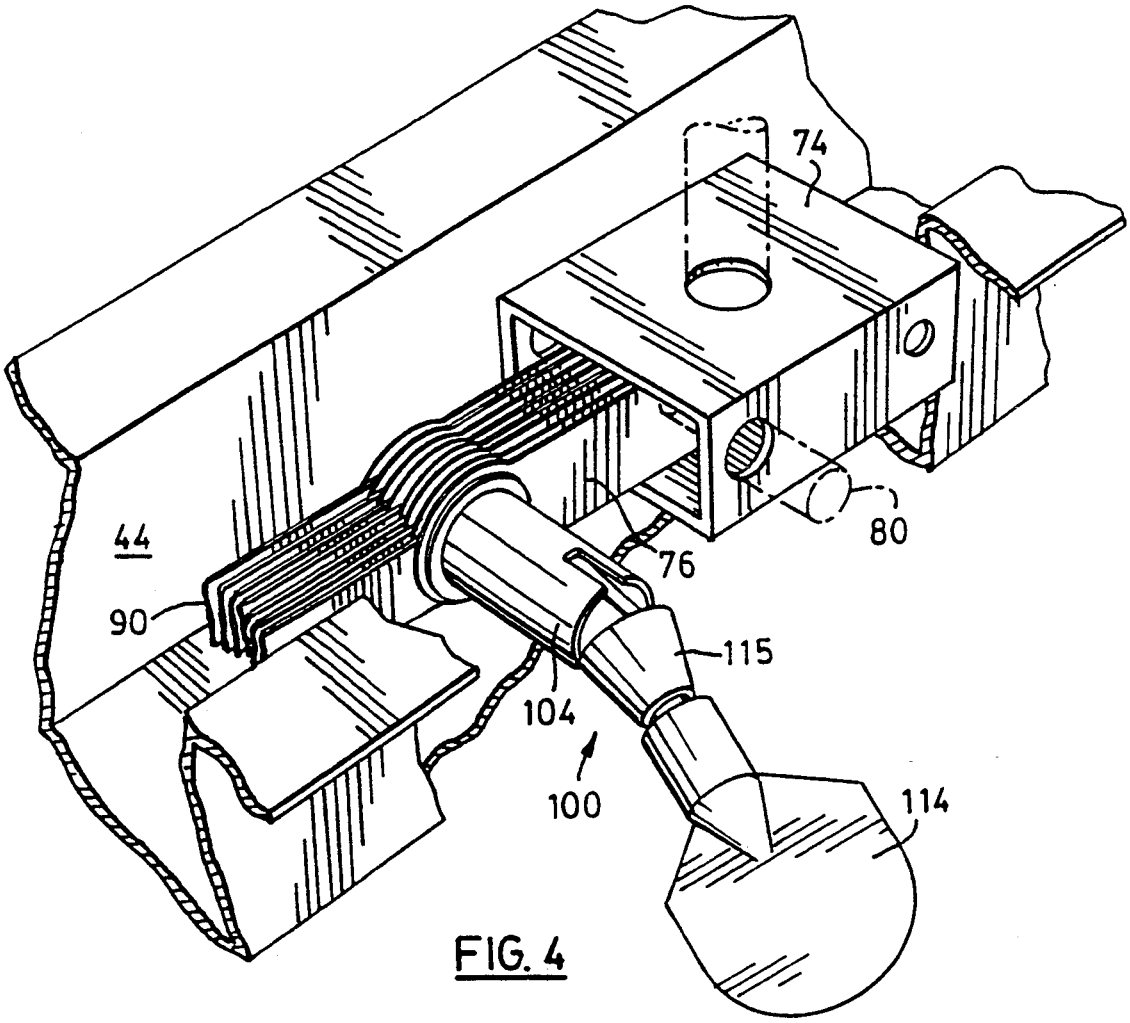
FIG. 4 is a perspective view, broken away, of part of the prior art brake mechanism of FIGS. 2 and 3.
Figure 5:
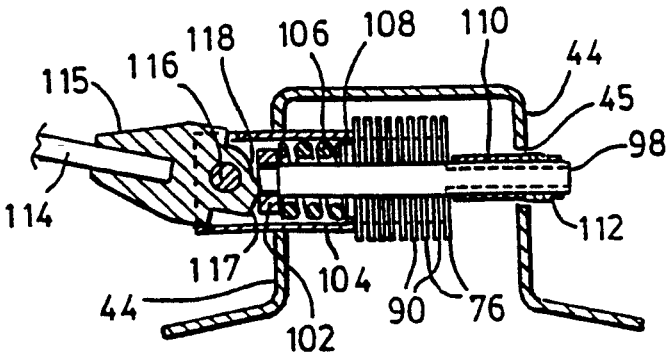
FIG. 5 is a view along line 5—5 of FIG. 2.

Referring to FIGS. 3–5, locking rod 98 forms part of a locking mechanism shown generally at 100. Locking mechanism 100 comprises locking bolt 98, which is threaded, extending between and through side walls 44 in holes 45 of housing 42. As discussed above, bolt 98 passes transversely through slots 78 and 94 in arms 76 and 90 respectively. Bolt 98 includes a head portion 102 located on the outside of housing 42 and on the inside of a sheath 104 which protrudes through one of the side walls 44. Sheath 104 is rigidly affixed to side wall 44 and does not move. A spring 106 is disposed within sheath 104 between side wall 44 and inturned end portion 108 of the sheath adjacent arms 90 and 76. The other end of threaded bolt 98 passes through a sheath 110 and a nut 112 threadably received on the end of the bolt retains the sheath on the bolt, best seen in FIG. 5. Sheath 110 abuts the outermost lammal arm and moves with bolt 98 so that in the locked position arms 76 and 90 are compressed between sheath 110 and the inturned portion 108 of sheath 104. Sheath 110 and bolt 98 are slidable through hole 45. A locking arm or lever 114 is secured to a frusto-conically shaped connector 115 which in turn is pivotally attached to sheath 104 by pin 116. Connector 115 comprises two adjacent surfaces 117 and 118 disposed at an angle with respect to each other. Pivoting locking arm 114 until surface 117 is adjacent to the top surface of head 102 acts to push bolt 98 inwards against the force of spring 106 thereby relieving the compression on arms 90 and 76. When locking arm 114 is pivotted to the position in which surface 118 is adjacent to the top surface of head 102, bolt 98 is retracted by spring 106 thereby compressing arms 76 and 90 thereby locking mounting 46 and seat 30 in position.

Figure 6:
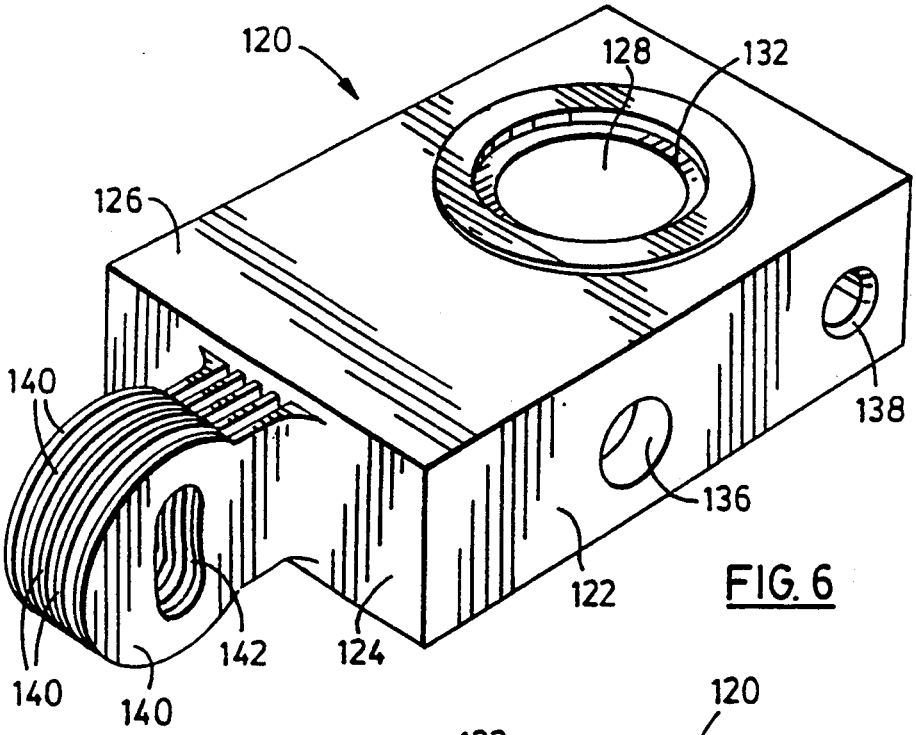
FIG. 6 is a perspective view of part of the brake mechanism forming the subject invention.
Figure 7:
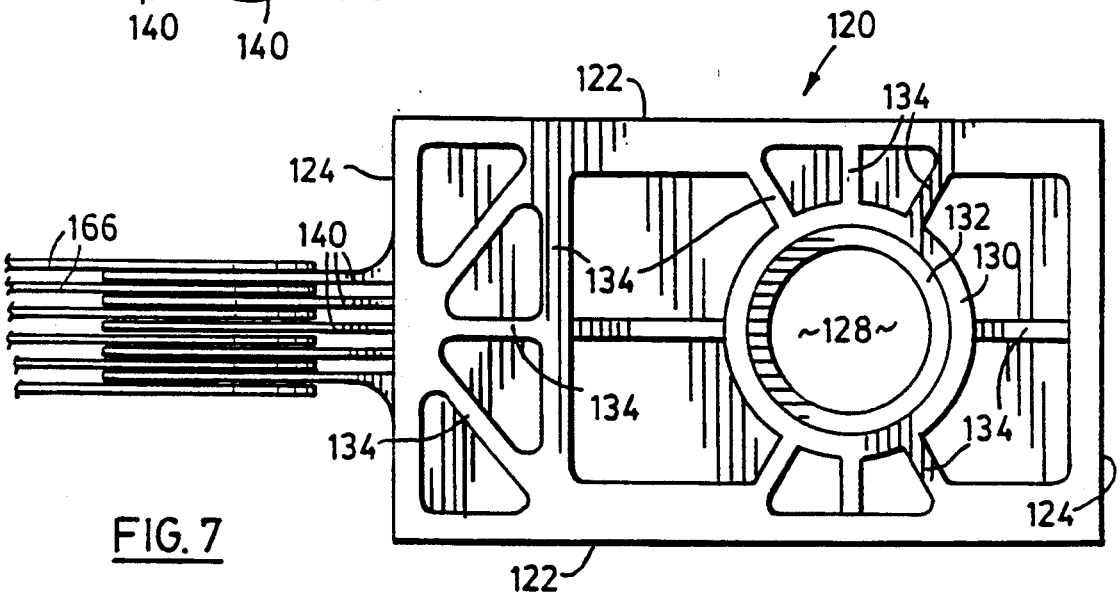
FIG. 7 is a bottom view, broken away, of the brake mechanism constructed in accordance with the present invention.

Referring now to FIGS. 6 to 13, various embodiments and parts thereof of the seat tilt mechanism comprising the subject invention will now be discussed. FIGS. 6 and 7 illustrate a generally rectangular spindle bracket 120 having opposing side walls 122, opposing end walls 124 and a top surface 126. A hole 128 extends through top surface 126 and is bordered by a collar 130 integrally formed with bracket 120. A metal sleeve 132 is located in hole 128 and suitably sized so that it is tightly held in place against collar 130 in bracket 120. Spindle 28 (FIG. 1) is received within hole 128 when the chair is assembled and the presence of metal sleeve 132 ensures a metal on metal coupling with the spindle and bracket 120. Spindle bracket 120 includes various reinforcing webs 134 provided to increase the strength of the bracket. Bracket 120 is provided with holes 136 and 138 extending through opposed side walls 122. Holes 136 are for receiving a pivot rod for mounting bracket 120 in the tilt mechanism housing, as will be presently discussed. Bracket 120 includes a plurality of front lammals or arms 140 integrally formed therewith and extending from the end wall 124 of the bracket spaced furthest from hole 128. Arms 140 extend parallel to each other and are provided with elongate slots 142. Spindle bracket 120 is of one piece unitary construction and is moulded of a hard plastic material such as glass reinforced nylon. This material has been found to produce a strong spindle bracket sufficient to withstand the stresses on arms 140 forming part of the bracket. Normal nylon would not be strong enough to withstand the stresses routinely applied to the bracket and therefore would not result in a safe bracket. In choosing alternate materials from which to construct bracket 120, due consideration must be given to this safety feature. A bushing (not shown) is positioned in hole 136 to receive the pivot rod so that the rod is not worn down by the bracket during use. In addition to the considerable economic saving and lightweight of spindle bracket 120, the latter provides a construction with less stress placed on the connection between arms 140 and the main body portion of the bracket compared to the prior art bracket 74 shown in FIG. 4. This is because bracket 120 is moulded with shorter arms 140 compared to arms 76 of bracket 74.

Figure 8:
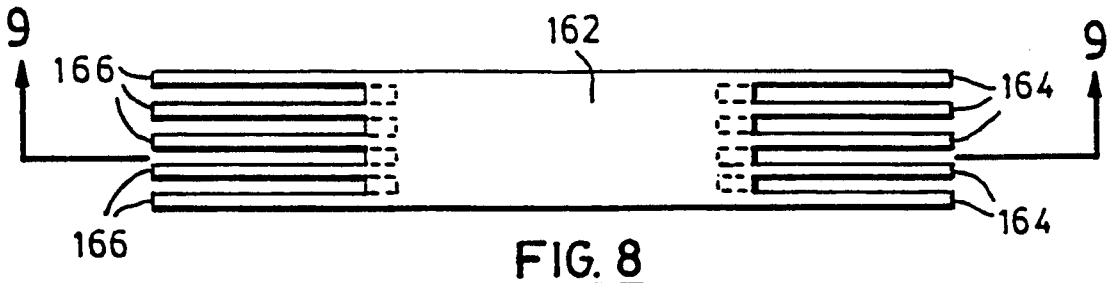
FIG. 8 is top view of a rear lammal forming part of the present invention.
Figure 9:
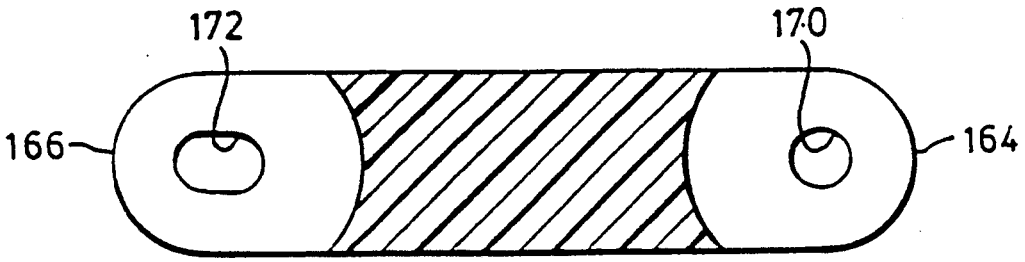
FIG. 9 is a sectional view along line 9—9 of FIG. 8.

Referring to FIGS. 8 and 9, a portion of the seat locking mechanism referred to hereinafter as a rear lammal is shown generally at 160. Rear lammal 160 is of one piece unitary construction being fabricated of a hard moulded plastic and includes a central body portion 162 provided with a plurality of parallel arms 164 extending from one end and a plurality of parallel arms 166 extending from the other end thereof. Referring to FIG. 8, arms 166 are provided with a hole 170 extending therethrough and arms 168 are each provided with a slot 172 extending therethrough. Holes 170 and slots 172 are in registration in each of the adjacent arms so that rods can be received through the holes and slots. Lammal 160 is preferably fabricated of a hard material such as glass reinforced nylon. The inventors have found that normal nylon warps during extended usage due to the high stresses present on the lammal. Using shorter lammals may alleviate this problem.

Figure 10:
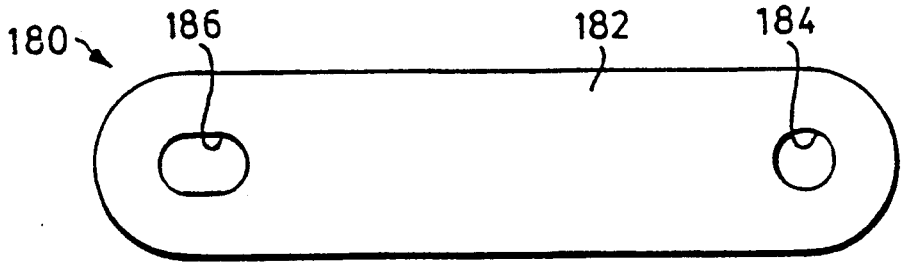
FIG. 10 is a side elevation of an alternative embodiment of a rear lammal.

FIG. 10 illustrates an alternative embodiment of a rear lammal shown at 180 which may be used in conjunction with spindle bracket 120 illustrated in FIG. 6. Lammal 180 comprises a single elongate arm 182 having a hole 184 adjacent one end and a slot adjacent another end thereof. Lammals 180 are essentially the same as those used in the prior art seat tilt mechanism of FIGS. 2 to 4. Lammal 180 may be fabricated of steel or other hard materials such as glass filled nylon. A plurality of lammals 180 would be used with spindle bracket 120. It will be appreciated by those skilled in the art that based on the foregoing discussion, lammal 160 is the preferred lammal to be used with spindle bracket 120.

Figure 11:
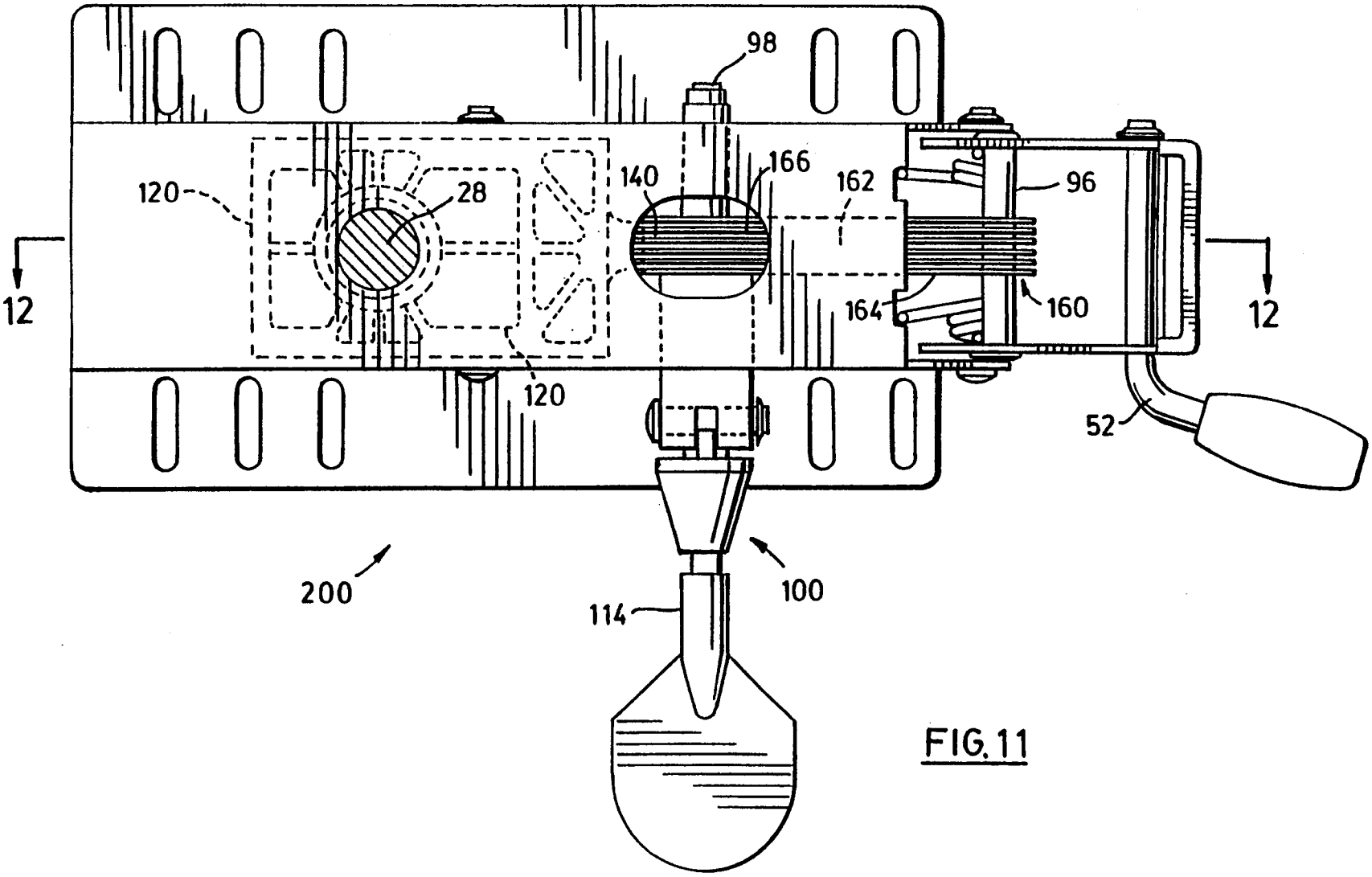
FIG. 11 is a bottom view of a chair seat tilt mechanism constructed in accordance with the present invention.
Figure 12:
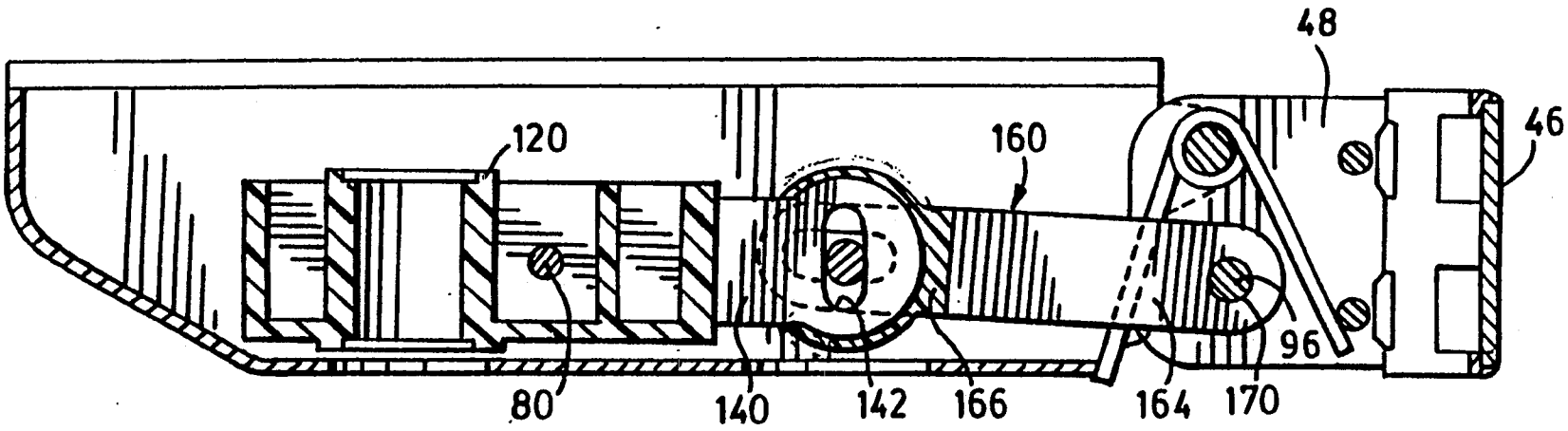
FIG. 12 is a sectional view along the line 12—12 of FIG. 11.
Figure 13:
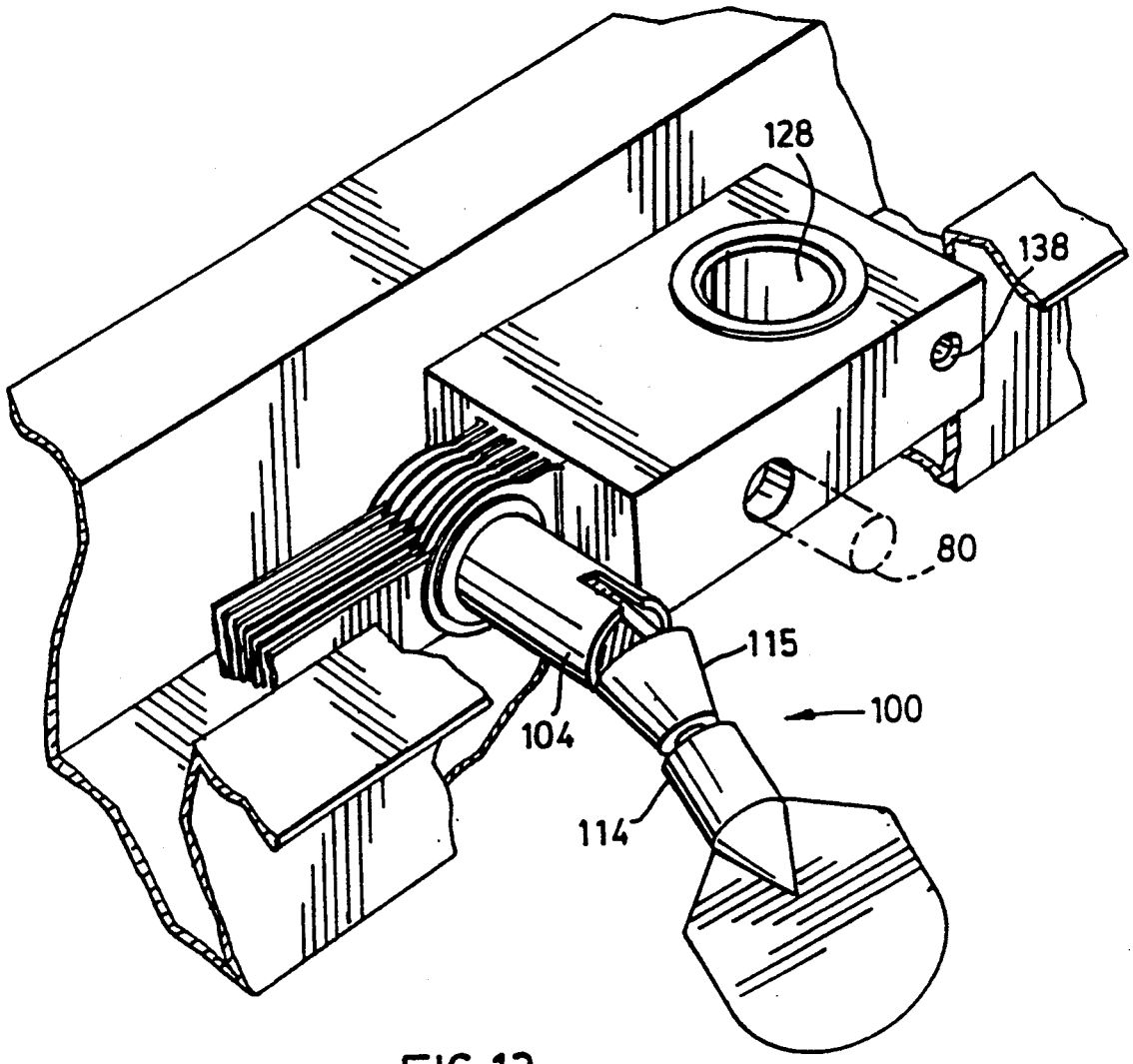
FIG. 13 is a perspective view, broken away, of part of the seat tilt mechanism forming the present invention.

An assembled seat tilt mechanism 200 shown in FIGS. 11 and 12 comprises arms 166 of rear lammal 160 interleaved with front lammals 140 of spindle bracket 120. Bolt 98 of locking mechanism 100 extends through slots 142 and 172 of lammals 140 and arms 166 of lammal 160 respectively. Lammal 160 is pivotally mounted on rod 96 extending between side walls 48 of bracket 46 through holes 170 in arms 164. The functioning of locking mechanism 100 of FIGS. 11 and 13 is identical to that shown in FIG. 5.

Spindle bracket 120 is preferably fabricated of glass reinforced nylon to withstand the high stresses routinely applied to the spindle bracket. Lammal 160 may also be fabricated of glass reinforced nylon. It will be appreciated that instead of lammal 160 being used, a plurality of lammals 180 (FIG. 10) may be used. Lammals 180 may be fabricated of steel such as in the prior art or alternatively may be moulded from glass reinforced nylon. However, those skilled in the art will appreciate the advantages associated with using the unitary lammal 160. This unitary lammal avoids the requirement of having to align individual arms relative to one another during assembly of tilt mechanism 70.

In operation, to unlock seat 30 and seat back 32 (FIG. 1), a user moves locking arm 114 in tilt mechanism 200 to the unlocked position so that arms 140 and 160 are no longer compressed together. Spindle bracket 120 will now pivot about rod 80 when a user shifts his or her position on seat 30 with arms 140 moving up and down with respect to bolt 98 in slots 142. With locking mechanism 100 in the unlocked position lammal 160 is free to move when the user leans back against seat back 32 causing bracket 46 to pivot about rod 58. Moving locking arm 114 to the locked position compresses arms 140 and 166 together so that lammal 160 is held fixed thereby locking bracket 46 of seat back support mechanism 36 from further movement. This acts to lock seat back 32 in position. Spindle bracket 120 is locked against pivotal movement so that seat 30 is locked in position.

In another embodiment, the seat tilt mechanism of the present invention may be modified slightly to prevent pivotal movement of spindle bracket 120. Referring to FIGS. 1 and 13, this may be achieved by inserting a rod (not shown) through hole 138 of bracket 120 and side walls 44 of housing 42. In this way seat 30 is prevented from pivoting and only seat back 32 can pivot. The unitary brake now acts to lock and unlock seat back 32 only.

By choosing the dimensions of arms 166 to ensure they are oversized with respect to arms 140, see FIG. 12, maximum friction is achieved between the arms in the locked position thereby giving a better seat and back rest lock. It has also been found that good frictional engagement between arms 140 and 160 is achieved when glass reinforced nylon is used for bracket 120 and steel used for arms 160.

There are several advantages achieved with moulded spindle bracket 120 and unitary rear lammal 160 disclosed herein. The spindle bracket is much lighter and more economical to fabricate than the prior art metal spindle bracket discussed earlier. Since arms 140 are integrally formed with the rest of the bracket 120, there are no problems similar to those encountered with the prior art associated with the alignment of arms 140 relative to one another or with the quality of the connection between the arms and the rest of the bracket. In addition, spindle bracket 120 the provides a construction with less stress placed on the connection between arms 140 and the main body portion of the bracket compared to the prior art bracket 74 shown in FIG. 4. This is because bracket 120 is moulded with shorter arms 140 compared to arms 76 of bracket 74.

The moulded unitary rear lammal 160 is advantageous because it is lighter than the individual metal arms and arms 164 and 166 are fixed with respect to one another so the lammal can be rapidly mounted within tilt mechanism 200. This results in considerable savings over the fabrication and assembly of the tilt mechanism. In addition, unitary lammal 160 provides for a smoother ride during movement of the seat and seat back due to arms 164 and 166 being held fixed relative to one another.

While the seat tilt mechanism utilizing the brake of the present invention has been described and illustrated with respect to the preferred embodiment, it will be appreciated that numerous variations of this embodiment may be made without departing from the scope of invention.

What is claimed is:

1. A chair having a seat with an underside and a seat tilt mechanism attached to the underside, the seat tilt mechanism provided with a housing, the chair having a seat back with a seat back support arm attached thereto and also having a seat back support mechanism comprising a mounting bracket pivotally attached to an end portion of said housing, said seat back support arm being attached to said mounting bracket, the chair including spring means for biasing said mounting bracket with respect to said housing, the chair including means defining a brake for locking said mounting bracket and said chair seat, said brake means including a spindle bracket pivotally mounted in said housing for receiving therein a chair support spindle, the spindle bracket being provided with at least three parallel arms extending therefrom, said arms each having slots extending therethrough, the brake means including means defining a rear lammal, said rear lammal means being pivotally mounted on said mounting bracket, said rear lammal means comprising arms interleaved with said spindle bracket arms, said rear lammal arms having slots extending therethrough and being in registration with said slots in the spindle bracket arms, said registered slots for receiving a locking bolt transversely through said arms, wherein said locking bolt is movable between a first position in which said interleaved arms are compressed together for locking the chair seat and the seat back in position and a second position in which the arms of the spindle bracket are free to move with respect to the arms of the rear lammal means, said spindle bracket and said arms extending therefrom being of one piece unitary construction.

2. The chair according to claim 1 wherein said unitary spindle bracket and arms extending therefrom are a moulded plastic.

3. The chair according to claim 2 wherein said moulded plastic is glass reinforced nylon.

4. The chair according to claim 1 wherein said rear lammal means comprises a plurality of individual lammals moulded from glass reinforced plastic.

5. The chair according to claim 4 wherein said glass reinforced plastic is glass reinforced nylon.

6. The chair according to claim 1 wherein said rear lammal is a one piece unitary lammal comprising a central body portion having opposed ends, a plurality of first substantially parallel arms extending from one end of said central body portion and a plurality of second substantially parallel arms extending from the other end of said central body portion, said first arms each provided with slots located therein through which said locking bolt transversely passes and said second arms each provided with holes located therein through which said mounting rod transversely passes.

7. The chair according to claim 6 wherein said unitary rear lammal is moulded from glass reinforced plastic.

8. The chair according to claim 7 wherein said glass reinforced plastic is glass reinforced nylon.

9. A unitary brake for a chair tilt mechanism, the chair tilt mechanism having a seat back support mechanism biased with respect to a seat tilt mechanism, the seat back support mechanism including a mounting bracket and the seat tilt mechanism including a housing and being attachable to a chair seat's underside, the mounting bracket being pivotally attached to the housing adjacent to an end portion thereof, a locking mechanism for locking the seat and the mounting bracket, the unitary brake comprising;

a spindle bracket pivotally mounted in said housing for receiving therein a chair support spindle, the spindle bracket being provided with at least three parallel arms extending therefrom, said spindle bracket and said arms extending therefrom being of one piece unitary construction, said arms each having slots extending therethrough, the unitary brake including means defining a rear lammal, said rear lammal means being pivotally mounted on said mounting bracket, said rear lammal means comprising arms interleaved with said spindle bracket arms, said rear lammal arms having slots extending therethrough and being in registration with said slots in the spindle bracket arms, said registered slots for receiving a locking bolt transversely through said interleaved arms, wherein said locking mechanism includes a locking bolt movable between a first position in which said interleaved arms are compressed together for locking the chair seat and the mounting bracket in position and a second position in which the arms of the spindle bracket are free to move with respect to the arms of the rear lammal means.

10. The unitary brake according to claim 9 wherein said unitary spindle bracket and arms extending therefrom are a moulded plastic.

11. The unitary brake according to claim 10 wherein said moulded plastic is glass reinforced nylon.

12. The unitary brake according to claim 9 wherein said rear lammal comprises a plurality of individual lammals moulded from glass reinforced plastic.

13. The unitary brake according to claim 12 wherein said glass reinforced plastic is glass reinforced nylon.

14. The unitary brake according to claim 9 wherein said rear lammal is a unitary lammal comprising a central body portion having opposed ends, a plurality of first substantially parallel arms extending from one end of said central body portion and a plurality of second substantially parallel arms extending from the other end of said central body portion, said first arms each provided with slots located therein through which said locking bolt transversely passes and said second arms each provided with holes located therein through which said mounting rod transversely passes.

15. The unitary brake according to claim 14 wherein said unitary rear lammal is moulded from glass reinforced plastic.

16. The unitary brake according to claim 15 wherein said glass reinforced plastic is glass reinforced nylon.

17. A chair having a tiltable seat and seat back, comprising;

a) a chair base having a vertically disposed spindle extending upwardly therefrom, and a seat pivotally attached to said spindle;

b) a seat back having a seat back support arm connected at one end to said seat back;

c) a seat tilt mechanism provided with a housing and attachable to an underside of said seat, and a seat back support mechanism comprising a mounting bracket pivotally attached to said housing adjacent to an end portion of the housing, said seat back support arm being attached to said mounting bracket, the mounting bracket being biased with respect to said housing; and d) a unitary brake comprising a spindle bracket pivotally mounted in said housing for receiving therein said chair support spindle, the spindle bracket being provided with at least three parallel arms extending therefrom, said spindle bracket and said arms extending therefrom being of one piece unitary construction, said arm each having slots extending therethrough, the unitary brake including means defining a rear lammal, said rear lammal means being pivotally mounted on said mounting bracket, said rear lammal means comprising arms interleaved with said spindle bracket arms, said rear lammal arms having slots extending therethrough and being in registration with said slots in the spindle bracket arms, said registered slots for receiving a locking bolt transversely through said interleaved arms, wherein said locking bolt is movable between a first position in which said interleaved arms are compressed together for locking the chair seat and the seat back in position and a second position in which the arms of the spindle bracket are free to move with respect to the arms of the rear lammal means so that the seat can pivot about the horizontal and the seat back can pivot to and fro about the vertical.

18. The chair according to claim 17 wherein said unitary spindle bracket and arms extending therefrom are a moulded plastic.

19. The chair according to claim 18 wherein said moulded plastic is glass reinforced nylon.

20. The chair according to claim 17 wherein said rear lammal comprises a plurality of individual lammals moulded frcm glass reinforced plastic.

21. The chair according to claim 20 wherein said glass reinforced plastic is glass reinforced nylon.

22. The chair according to claim 17 wherein said rear lammal is a one piece unitary lammal comprising a central body portion having opposed ends, a plurality of first substantially parallel arms extending from one end of said central body portion and a plurality of second substantially parallel arms extending from the other end of said central body portion, said first arms each provided with slots located therein through which said locking bolt transversely passes and said second arms each provided with holes located therein through which said mounting rod transversely passes.

23. The chair according to claim 22 wherein said one piece unitary rear lammal is moulded from glass reinforced plastic.

24. The chair according to claim 23 wherein said glass reinforced plastic is glass reinforced nylon.

25. The chair according to claim 24 wherein said first arms of the rear lammal are oversized with respect to the arms extending from said spindle bracket to provide maximum friction between the interleaved arms.

* * * * *